US005502552A

United States Patent [19]

Iwata et al.

[11] Patent Number: 5,502,552

[45] Date of Patent: Mar. 26, 1996

[54] DEVELOPING DEVICE FOR AN IMAGE FORMING APPARATUS

[75] Inventors: Naoki Iwata; Takeshi Saito, both of Tokyo; Hidetoshi Yano; Hiromitsu Takagaki, both of Yokohama; Kazuhiro Nishido, Tokyo; Ichiro Komuro; Shigeki Sawa, both of Yokohama; Nobuhiro Shima, Gotenba, all of Japan

[73] Assignee: Ricoh Company, Ltd., Tokyo, Japan

[21] Appl. No.: 261,976

[22] Filed: Jun. 17, 1994

[30] Foreign Application Priority Data

Jun. 19, 1993 [JP] Japan ..... 5-172449

[51] Int. Cl.[6] ..... G03G 15/06

[52] U.S. Cl. ..... 355/259; 355/245; 355/261; 118/647; 118/651

[58] Field of Search ..... 355/259, 245, 355/261, 262; 118/644, 647, 648, 651, 656, 661; 430/101, 120

[56] References Cited

U.S. PATENT DOCUMENTS 3,203,394 8/1965 Hope et al. ..... 355/259 X
3,696,783 10/1972 Fantuzzo ..... 118/651 X
4,011,834 3/1977 Stephan ..... 118/653
4,100,884 7/1978 Mochizuki et al. ..... 118/653
4,331,754 5/1982 Stephan ..... 118/653 X
4,564,285 1/1986 Yasuda et al. ..... 118/648 X
5,365,318 11/1994 Hiraoka et al. ..... 355/246

*Primary Examiner*—Matthew S. Smith
*Attorney, Agent, or Firm*—Oblon, Spivak, McClelland, Maier & Neustadt

[57] ABSTRACT

In a developing device for an image forming apparatus, a developing roller has dielectric portions and conductive portions distributed regularly or irregularly over the surface thereof. The surfaces of the dielectric portions are smaller in height than the surfaces of the conductive portions. The difference in height is greater than one-half of the volumetric mean particle size of a toner. A charge opposite in polarity to a charge to be deposited on the toner is deposited on the dielectric portions. The dielectric portions, or recesses, each has a width more than three times as great as the volumetric mean particle size of the toner and a depth less than five times the volumetric particle size. The dielectric portions may be greater in height than the conductive portions and may be implemented as spiral grooves inclined more than 30 degrees relative to the axis of rotation of the developing roller. The developing roller may be moved at a higher linear velocity than a photoconductive drum.

14 Claims, 7 Drawing Sheets

DEVELOPING DEVICE FOR AN IMAGE FORMING APPARATUS

BACKGROUND OF THE INVENTION

The present invention relates to a copier, facsimile, printer or similar image forming apparatus and, more particularly, to a developing device for use in an image forming apparatus and including a developing roller or similar developer carrier having dielectric portions and conductive portions, which are connected to ground, distributed regularly or irregularly over the surface thereof.

In an image forming apparatus, a latent image is electrostatically formed carrier and then on an image developed by a developer. The developer is advantageously implemented by a single component type developer, or toner, since this type of developer miniaturizes a developing apparatus, reduces cost, and enhances reliability. Particularly, for color development, a nonmagnetic single component type developer, which has inherently high transparency, is desirable. The developing device using this kind of developer may include a developer carrier for carrying the developer on the surface thereof and conveying it along a predetermined circulation path, including a developing region, developer storing means for storing the developer, and a developer supply member for supplying the developer from the storing means to the developer carrier, as taught in, for example, Japanese Laid-Open Patent Publication Nos. 60-229057 and 61-42672.

In the developing device using a nonmagnetic single component type developer, or toner as referred to hereinafter, the toner and a charge should each be deposited in an optimal amount on the developer carrier, as follows. The toner should preferably be deposited on the developer carrier such that it is transferred to the image carrier in an amount of about 0.6 mg/cm$^2$ to 1.0 mg/cm$^2$ and to a paper or similar recording medium in an amount of 0.5 mg/cm$^2$ to 0.7 mg/cm$^2$. The amounts of toner as measured on the image carrier and paper depend not only on the amount of toner deposited on the developer carrier, but also on a difference in peripheral speed between the image carrier and the developer carrier in a developing region.

However, a problem with this type of conventional developing device is that the toner is deposited on the developer carrier only in a single layer, i.e., in an amount of 0.2 mg/cm$^2$ to 0.5 mg/cm$^2$. Hence, the desirable amounts of toner deposition on the image carrier and paper mentioned above cannot be attained unless the developer carrier is moved at a peripheral speed which is two to four times as high as that of the image carrier. However, increasing the rotation speed of the developer carrier makes it difficult to increase the image forming speed. Moreover, such a scheme brings about an undesirable occurrence that when a solid image having a substantial area is developed, the density increases at the rear edge portion of the image. Let this occurrence be referred to as toner offset hereinafter. The toner offset is not critical in a black-and-white image. However, when it comes to a color image whose colors are recognizable through toners, the density appears high in the rear edge portion and, in the case of a composite color image, results in a color different from the original color. In addition, the density becomes irregular around outline characters and prevents the entire image from appearing smooth.

To deposit a desired amount of toner on each of the image carrier and paper without causing the toner offset to occur, it is necessary that the peripheral speed of the developer carrier be brought close to that of the image carrier, i.e., nearly equispeed development be effected, and that a greater amount of toner be deposited on the developer carrier. Specifically, to insure the sufficient amounts of toner on the image carrier and paper by substantially equispeed development, the toner has to deposit on the developer carrier in an amount of at least 0.8 mg/cm$^2$ in the case of contact development, which has a high developing efficiency, or in an amount of at least 1.0 mg/cm$^2$ in the case of non-contact development whose developing efficiency is low. Such an amount of toner deposition on the developer carrier is not practicable unless it is deposited in two or more layers. Further, if the toner layer being conveyed toward the developing region by the developer carrier contains uncharged particles and reversely charged particles, it will degrade the transfer thereof to the image carrier, contaminate the background of an image, and lower resolution. In light of this, a charge should preferably be deposited on the toner in a mean amount of 5 μC/g to 10 μC/g. At the same time, since particles not sufficiently charged would lower sharpness and resolution and contaminate the background, the charge distribution on the toner should preferably be stable and contain hardly any particles of low charge.

As stated above, only if two or more toner layers are formed on the developer carrier with a mean amount of charge of 5 μC/g to 10 μC/g and in a stable charge distribution free from uncharged toners and reversely charged toners, it is possible to increase the image forming speed and effect equispeed development capable of eliminating the previously stated toner offset.

To implement stable multiple toner layers and convey them to the image carrier carrier, Japanese Patent Laid-Open Publication No. 2-15110, for example, proposes a developing device which forms fine closed electric fields, or so-called microfields, on the surface of the developer carrier. However, the problem with type of developing device is that when the amount of charge frictionally deposited on the toner decreases or the amount of charge induced decreases due to ambient temperature and/or humidity, the amount in which the toner is deposited on and conveyed by the developer carrier is apt to change, lowering image density.

SUMMARY OF THE INVENTION

It is, therefore, an object of the present invention to provide a developing device for an image forming apparatus which forms multiple developer layers on an image carrier stably without regard to ambient temperature or humidity, thereby insuring stable image quality.

In accordance with the present invention, a developing device having a developer carrier whose surface is comprised of a mixture of dielectric portions and conductive portions distributed regularly or irregularly forms fine closed electric fields on the developer carrier by selectively charging the surface, causes a developer to deposit on the surface in multiple layers due to the electric fields, and develops a latent image electrostatically formed on an image carrier by the developer. One of the dielectric portions and conductive portions constitutes recesses having a difference in height which is greater than one-half of the volumetric mean particle size of the developer, while the other of the dielectric portions and conductive portions constitutes projections.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the developing device in accordance with the present invention will be described which are applied to an electrophotographic copier.

1st Embodiment

Figure 1:
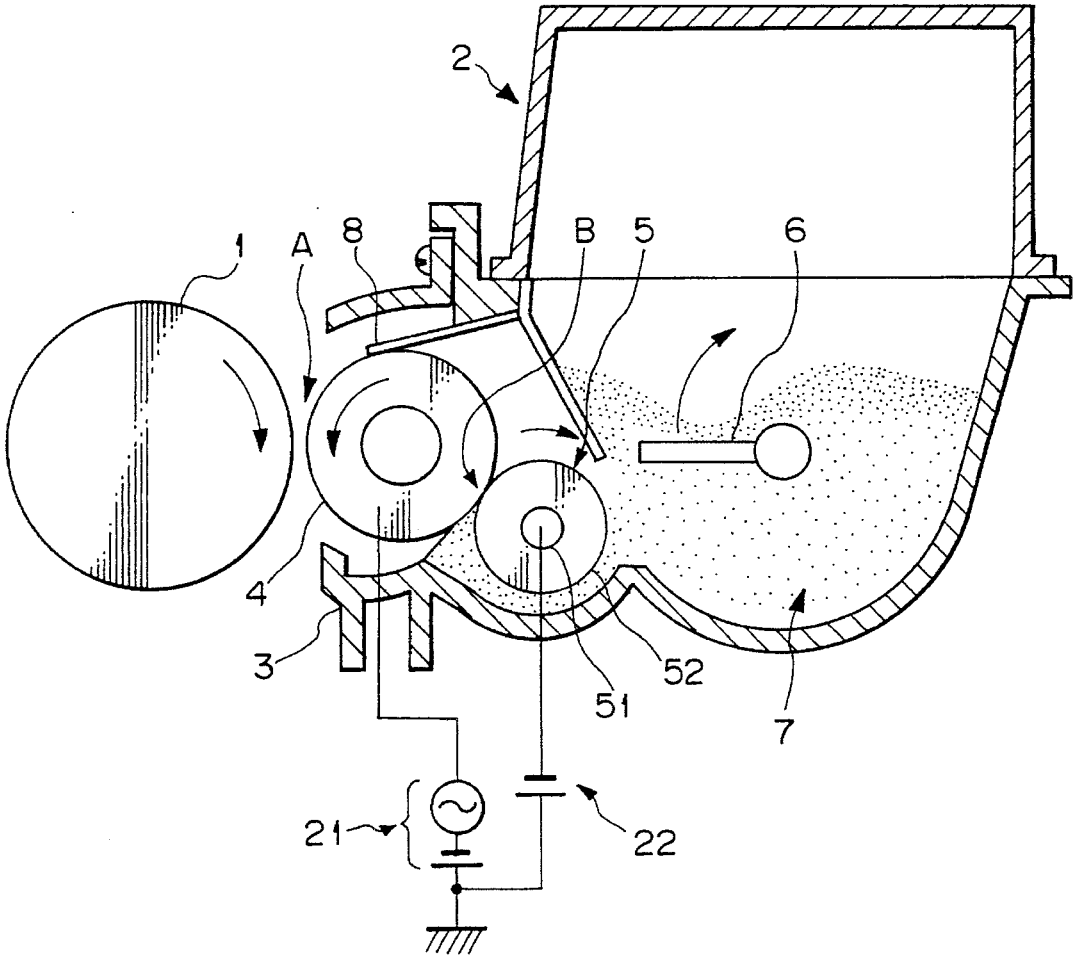
FIG. 1 is a section showing a first embodiment of the developing device in accordance with the present invention.

Referring to FIG. 1 of the drawings, a developing device embodying the present invention is shown. As shown, a photoconductive drum, or image carrier, 1 is rotatable at a linear velocity of, for example, 200 mm/sec in a direction indicated by an arrow in the figure, i.e., clockwise. A developing device, generally 2, is positioned at the right-hand side of the drum 1, as viewed in the figure. Arranged around the drum 1 are a main charger, optics for exposure, image transfer and paper separation unit, cleaning device and a discharger which are conventional, although not shown in the figure.

The developing device 2 has a casing 3 having an opening which faces the surface of the drum 1. A developing roller, or developer carrier, 4 is partly exposed to the outside via the opening of the casing 3 and rotatable at a predetermined linear velocity in a direction indicated by an arrow, i.e., counterclockwise. A toner supply roller, or toner supply member, 5 is pressed against the right part of the developing roller 4 and rotatable clockwise, as indicated by an arrow in the figure. A hopper is contiguous with the right part of the casing 3 and stores a fresh toner (single component type developer) 7 therein. An agitator 6 feeds the toner 7 from the hopper to the surface of the toner supply roller 5 while agitating the toner 7 in the hopper. As the developing roller 4 is rotated, the toner is sequentially conveyed by the roller 4 to a developing region A where the roller 4 faces the drum 1. A regulating member 8 levels the toner on the developing roller 4 to form a toner layer of uniform thickness.

In the developing region A, the developing roller 4 is spaced apart from the drum 1 by a preselected gap so as to effect non-contact development, as shown in FIG. 1. Alternatively, an arrangement may be made such that the toner layer on the developing roller 4 contacts the surface of the drum 1 to effect contact development. In any case, to prevent the toner from concentrating at the rear edge portion of an image, the developing roller 4 is rotated such that the surface thereof moves, in the region A, in the same direction as the surface of the drum 1 and at substantially the same linear velocity as the drum 1, i.e., about 220 mm/sec in the embodiment. In the event of contact development, however, if the surface of the drum 1 and that of the developing roller 4 are moved at exactly the same speed, the toner is apt to deposit on the drum 1 physically, i.e., without regard to the potential distribution on the surface of the drum 1. In light of this, the developing roller 1 is moved at a slightly higher linear velocity than the drum 1. A preferable ratio (drum 1 linear speed:roller 4 linear speed) is, for example, 1:1.05 to 1:1.1. Such a velocity ratio does not render the above-stated toner offset conspicuous.

A bias power source 21 applies a suitable bias voltage for development, e.g., DC, AC, DC-biased AC or pulse voltage to the developing roller 4. In the case of non-contact development, the bias voltage should preferably be implemented by a voltage including an alternating component which promotes the flight of the toner (AC, DC-biased AC, pulse voltage or the like).

Figure 2:
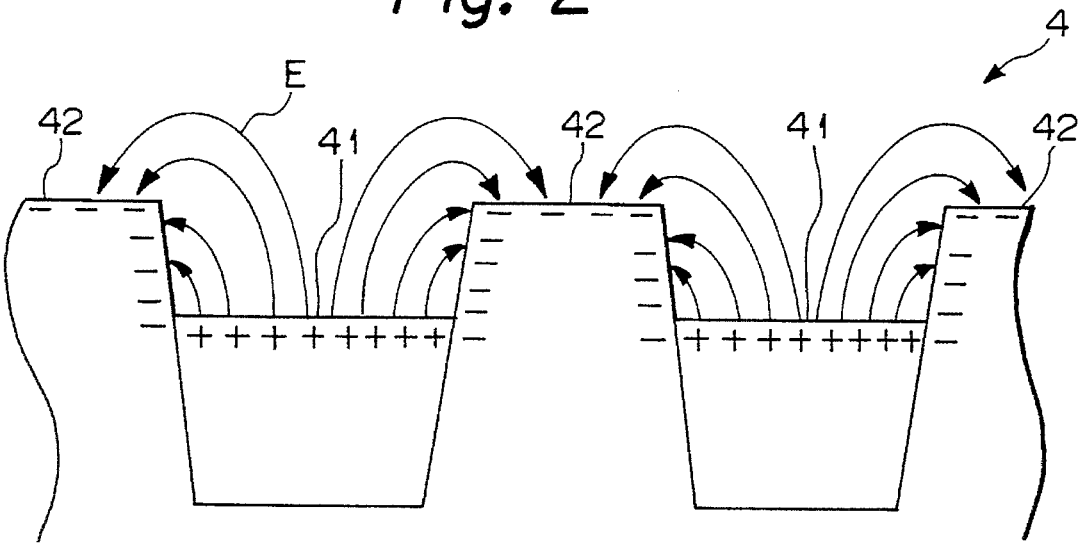
FIG. 2 is a fragmentary enlarged section showing the surface of a developing roller included in the embodiment.

As shown in FIG. 2, the developing roller 4 has on the surface thereof dielectric portions 41 and conductive portions 42 each having a small area. The dielectric portions 41 are capable of holding charges thereon while the conductive portions 42 are connected to ground. The two groups of portions 41 and 42 are different in height from each other. Such a roller configuration is successful in, for example, increasing the amount of toner to deposit thereon. The dielectric portions 41 are distributed on the roller 4 either randomly or in a regular pattern, and each has a width of, for example, about 50 μm to 200 μm. Regarding the area, the dielectric portions 41 should preferably occupy 40% to 70% of the entire surface of the roller 41. The difference in height between the portions 41 and 42 is greater than one-half of the volumetric mean particle size of the toner 7. A specific procedure for producing the roller 4 comprises the steps of knurling the surface of a metallic roller or core to form predetermined grooves, coating the knurled surface with a resin, machining the coated surface, and then cooling it to cause the resin to contract. As a result, the resin filled the grooves appears on the surface as the dielectric portions 41 which are lower than the conductive portions 42.

Referring again to FIG. 1, the toner supply roller 5 is made up of a metallic core 51 and a sponge layer, or elastic foam material, 52, covering the surface of the core 51. A number of cavities are formed in the surface of the roller 5 at least in the vicinity of the surface of the sponge layer 52 in order to hold the toner therein. The sponge layer 52 should preferably be made of a material intervening, in respect of a frictional charge series, between the material of the toner 7 and that of the developing roller 4, so that it can deposit a desired frictional charge on the toner and roller 4 in contact with the roller 4. The toner supply roller 5 is so positioned as to bite into the surface of the developing roller 4 by a predetermined amount. The roller 5 is driven such that the surface thereof moves in the same direction as that of the roller 4 at the position where the former contacts the latter. The linear velocity of the roller 5 is selected to be, for example, about 0.5 times to 2.5 times as high as that of the roller 4. The bias voltage applied to the roller 4 is also applied to the core 51 of the roller 5 from the bias power source 22. Alternatively, a bias voltage which provides the roller 5 with a potential difference of 50 V to 300 V from the roller 4 may be applied to the core 51 of the roller 5. Such a bias voltage will generate electric fields which subject the toner 7, frictionally charged to a predetermined polarity, to an electrostatic force acting from the roller 5 side toward the roller 4 side. The agitator 6 having the previously stated functions may be omitted if the toner 7 can be fed to the roller 5 by, for example, the fluidity or weight of the toner 7 or due to the configuration of the hopper.

The regulating member 8 abuts against the developing roller 4 at a low pressure of about 10 g/cm to 20 g/cm in the case of non-contact development or at a pressure of about 30 g/cm in the case of contact development. Why a high contact pressure is selected for contact development is that the adequate amount of toner deposition on the roller 4 is relatively small, e.g., 0.8 mg/cm$^2$ to 1.0 mg/cm$^2$ since the toner transfer ratio to the drum 1 is relatively high. The material of the regulating member 8, like that of the toner supply roller 5, should preferably intervene, in a frictional charge series, between the material of the toner and that of the dielectric portions 41.

A specific example of the illustrative embodiment will be described hereinafter.

(1) Developing Roller 4

Figure 3A:
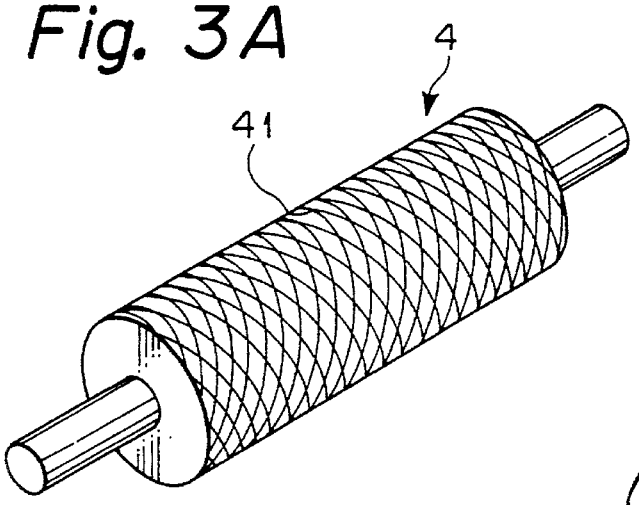
FIG. 3A is a perspective view showing the developing roller whose surface is knurled in a crosshatch pattern.
Figure 3B:
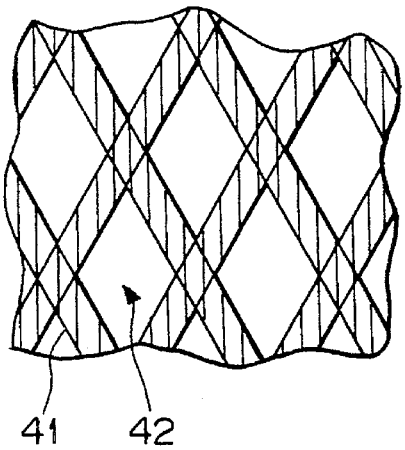
FIG. 3B is an enlarged view of the roller surface of FIG. 3A.
Figure 4A:
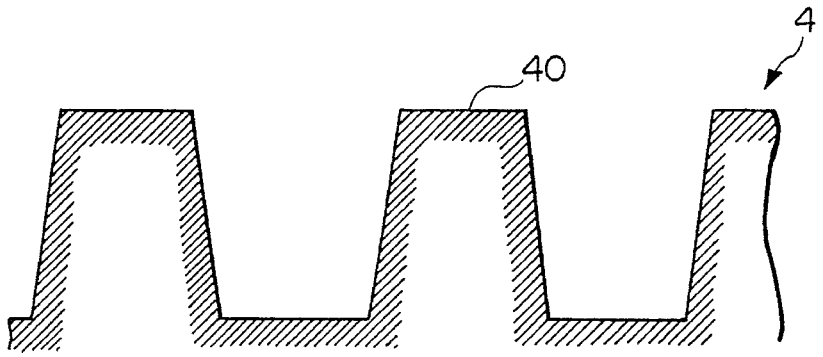
FIGS. 4A–4D are sections demonstrating a sequence of steps for configuring a roller surface in which dielectric portions are implemented as recesses.
Figure 4B:
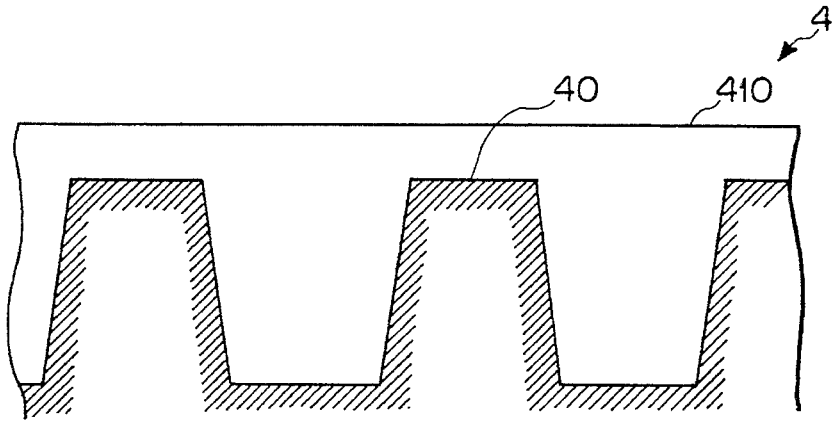
Figure 4C:
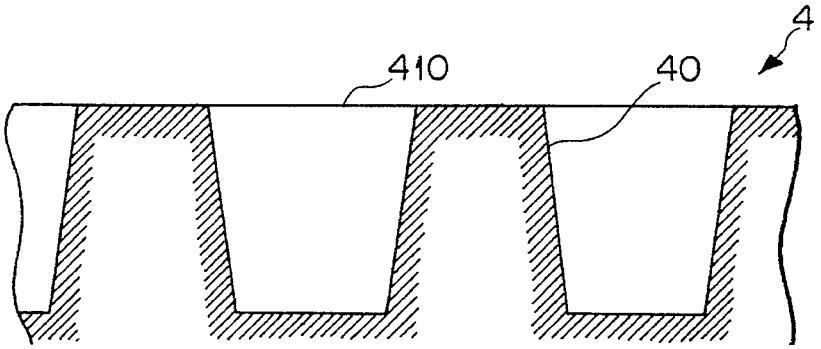
Figure 4D:
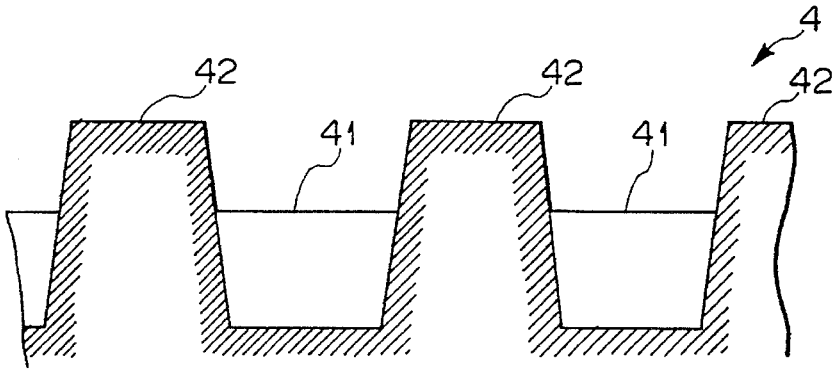

A metallic roller or core was knurled to form grooves, which were 0.1 mm deep and 0.2 mm wide, at a pitch of 0.3 mm and an angle of 45 degrees in a crosshatch pattern (see FIGS. 3A and 3B). The knurled surface of the core was coated with an epoxy degenerated silicone resin (SR 2115 available from Toray) 410 and then dried at 100° C. for about 30 minutes, thereby forming a dielectric coating (see FIGS. 4A and 4B). Subsequently, the surface of the roller was machined to cause the metallic core portions to appear as the conductive portions 42. The resin filled the grooves constituted the dielectric portions 41 (see FIG. 4C). The conductive portions 42 occupied 50% of the entire surface of the roller, meaning that the dielectric portions 41 also occupied 50% of the surface. Thereafter, the roller was cooled at −10° C. for about 30 minutes to cause the resin to contract. As a result, the surfaces of the dielectric portions (resin) 41 were made 10 μm to 20 μm lower than the surfaces of the conductive portions (aluminum) 42 (see FIG. 4D).

(2) Toner Supply Roller 5

The metallic core 51 had a diameter of 6 mm and was covered with the conductive sponge layer 52 having a resistivity of about $1\times10^6$ Ωcm. The total diameter of the roller 5 was 16 mm. The roller 5 was so positioned as to bite into the developing roller 4. The conductive sponge layer 52 was implemented by adding and dispersing 10 wt % of carbon in foam polyurethane, foaming and molding.

(3) Regulating Member 8

An elastic sheet which was 2 mm thick and had a rubber hardness of 73 degrees and a Young's modulus of 0.66 g/mm$^2$ was used. The elastic sheet was held in contact with the developing roller 4 at an edge angle of 90 degrees and at a pressure of 10 g/cm to 20 g/cm. For the elastic sheet, use was made of urethane rubber produced by molding after the addition and dispersion of 10 wt % of carbon.

(4) Bias Voltage 21 & Gap for Development

For example, an AC voltage biased by DC −700 V and having a peak-to-peak voltage of 1200 Vp-p and a frequency of 3 kHz is applied to the developing roller 4. The gap for development was selected to be 180 μm.

(5) Bias voltage 22 for Toner Supply Roller 5

Applied to the core 51 of the roller 5 is, for example, a bias voltage of the same polarity as the DC component of the bias voltage for development and 100 V (absolute value) higher than the latter, e.g., a DC bias voltage of −800 V when the DC component of the bias voltage for development is −700 V.

(6) Drum 1

Use was made of an OPC (Organic Photo Conductor) in the form of a drum. The drum was uniformly charged such that a negative latent image was −850 V in the background and −100 V in the image area.

(7) Toner 7

A negatively chargeable toner was used which consisted of a nonmagnetic styrene acryl resin and a polyester resin. The toner had a volumetric mean particle size of 10 μm. 0.5 wt % of fine $SiO_2$ powder was added to the outer periphery of the toner particles.

In operation, the agitator 6 feeds the toner 7 from the hopper to the surface of the toner supply roller 5. The roller 5, rotating clockwise, conveys the toner 7 toward a position B where it contacts the developing roller 4, while holding the toner 7 on the surface and in the cavities thereof. As the developing roller 4, toner 7 and toner supply roller 5 frictionally contact each other, a charge opposite in polarity to the charge of the toner is deposited on the dielectric portions 41 of the roller 4. The charge of the dielectric portions 41 will be the same in polarity as the charge of the drum 1 in the case of non-reversal development or opposite in polarity to the same in the case of reversal development. In the example described above, since reversal development is effected by use of a negatively chargeable toner, the dielectric portions 41 are charged to positive polarity. Fine closed electric fields, or microfields, are formed on the developing roller 4, as indicated by electric lines of force E in FIG. 2.

The surface of the toner supply roller 5 moves in the same direction as the surface of the developing roller 4. Hence, the toner 78 deposited on the roller 5 is rubbed between the rollers 4 and 5 with the result that most of the toner particles are charged to a desired polarity. The desired polarity mentioned is opposite to the polarity of the drum 1 in the case of non-reversal development or the same as the latter in the case of reversal development. In the example, the toner 7 is charged to negative polarity.

Figure 5A:
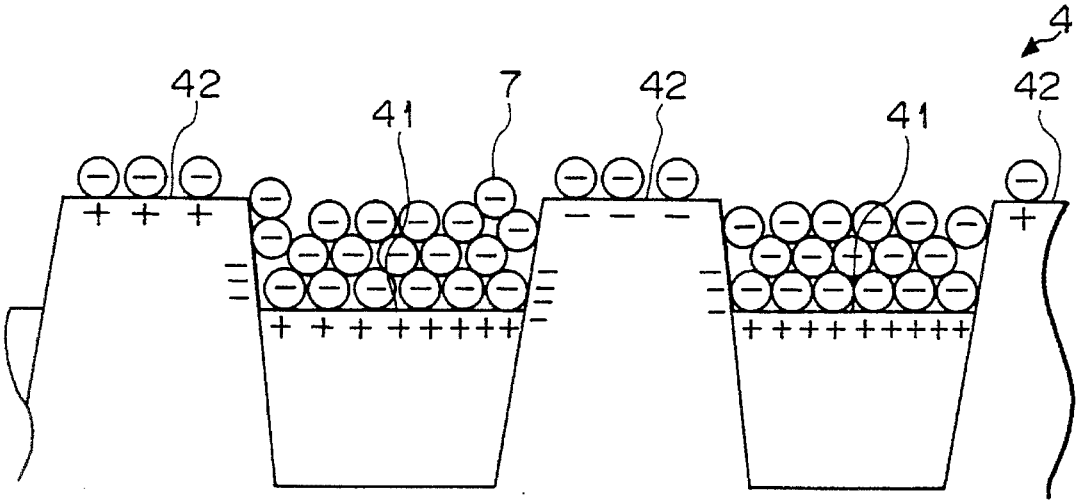
FIGS. 5A and 5B are sections respectively showing a roller surface in which the dielectric portions or recesses are positively charged and a roller surface in which they are negatively charged.

The charged toner 7 on the toner supply roller 5 is electrostatically held by the microfields E formed on the developing roller 4. As a result, the toner 7 is deposited in multiple layers on the roller 4, mainly the dielectric portions 41 and the edges between them and the conductive portions 42, as shown in FIG. 5A. The roller 4 leaves the contact portion B, carrying the sufficiently charged toner 7 in multiple layers thereon. In the illustrative embodiment, since the surfaces of the rollers 4 and 5 move in the same direction, the toner 7 on the roller 5 is rubbed between the rollers 4 and 5 and almost entirely charged. Therefore, despite the rotation of the roller 5, the non-charged or weakly charged toner 7 is prevented from being supplied from the hopper to the part of the roller 4 having moved away from the contact portion B.

Lightly contacting the developing roller 4, the regulating member 8 regulates the toner layer on the roller 4 to form a uniform thin toner layer (strictly, layers). Such a toner layer is brought to the developing region A by the roller 4. In the developing region A, contact or non-contact development is effected with the surface of the roller 4, to which an optimal bias voltage is applied, and that of the drum 1 moving at substantially the same speed. The toner left in the non-image area of the roller 4 without being deposited on the drum 1 is removed by the roller 5 mechanically and electrically. Also, the charge left on the roller 4 is made uniform by frictional charging caused by the roller 5. As a result, the surface of the roller 4 is initialized.

As stated above and as shown in FIG. 2, the embodiment has the dielectric portions 41 of the developing roller 4 which are smaller in height than the conductive portions 42, thereby implementing the portions 41 and 42 as recesses and projections, respectively. This enhances the vertically extending components of the microfields E between the two groups of portions 41 and 42 and, therefore, allows the toner 7 to be held by the roller 4 in multiple layers. In addition, the toner 7 received in such recesses can be conveyed mechanically. When the difference in height between the two groups of portions 41 and 42 is greater than one-half of the volumetric mean particle size of the toner 7, as in the embodiment, the toner 7 can be held in the regions where the vertically extending components of the microfields E on the roller 4 are formed. This, coupled with the fact that the recesses 41 are deep enough to convey the toner 7 mechanically, prevents the multiple toner layers from being destroyed even when they are leveled by the regulating member 8. As a result, the toner 7 is held by the roller 4 more strongly than conventional and can be deposited in multiple layers stably. It follows that even when ambient temperature and/or humidity changes, e.g., when humidity rises, stable toner layers can be formed on the roller 4 and conveyed to the drum 1 despite that the charge deposited on the dielectric portions 41 falls. Therefore, an attractive image is insured.

Specifically, at a temperature of 25° C. and humidity of 50%, a thin toner layer was successfully formed on the developing roller 4 and was measured to have a mass per unit area (M/A) of 1.2 mg/cm$^2$ to 1.8 mg/cm$^2$ and a charge per unit mass (Q/M) of −8 μC to −20 μC, which are sufficient for development. At a temperature of 30° C. and humidity of 90%, a toner layer having M/A of 1.0 mg/cm$^2$ to 1.3 mg/cm$^2$ and Q/M of −5 μC/g to −10 μC/g was formed on the roller 4. Further, at a temperature of 10° C. and humidity of 20%, a toner layer having M/A of 1.5 mg/cm$^2$ to 2 mg/cm$^2$ and Q/M of −12 μC/g to −20 μC/g was formed on the roller 4. When the toner layer on the roller 4 and the drum 1 were positioned face-to-face without contacting each other and a DC-biased pulse voltage was applied to the roller 4, image quality remained substantially constant without regard to temperature or humidity.

2nd Embodiment

Figure 5B:
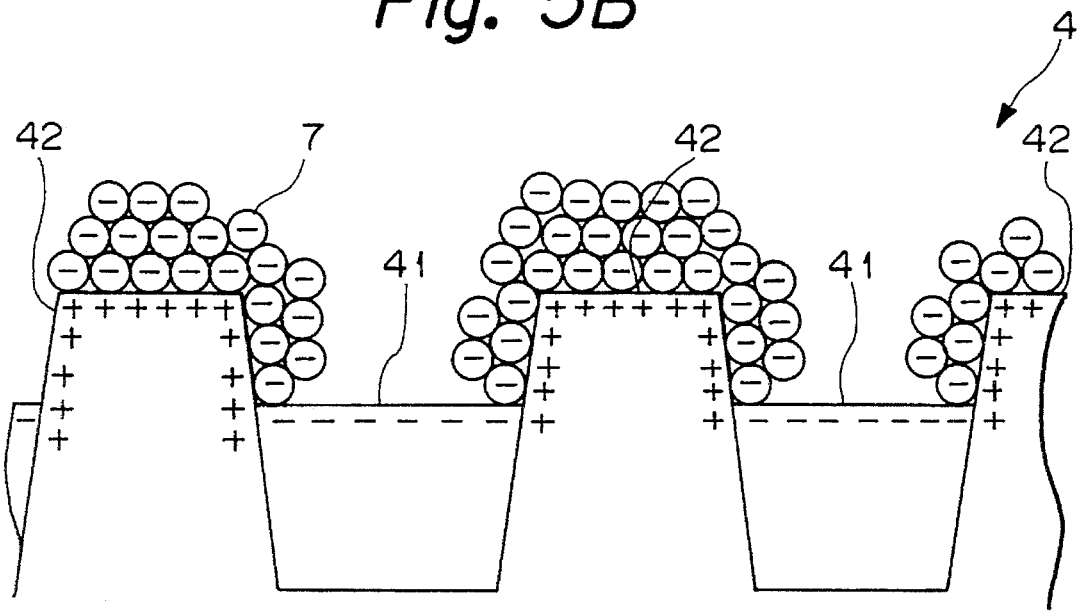

This embodiment uses the same developing device 2 and toner 7 as the first embodiment and configures the surface of the developing roller 4 in the same manner (see FIGS. 4A–4D). The difference is that this embodiment implements the dielectric portions 41 of the roller 4 by a fluoric resin and charges the portions 41 to the same polarity as the toner 7, i.e., negative polarity. In this condition, the toner 7 electrostatically repulses the dielectric portions 41 while being attracted by the conductive portions 42 due to a mirror image force. As a result, the toner 7 selectively deposits on the conductive portions 42 which are 10 μm to 20 μm higher than the dielectric portions 41, as shown in FIG. 5B. With this roller 4, it is also possible to form a toner layer whose M/A ranges from 1.0 mg/cm$^2$ to 1.7 mg/cm$^2$ and Q/M ranges from −5 μC/g to −15 μC/g, at a temperature of 30° C. to 20° C. and humidity of 90% to 15%. When the roller 4 was used to effect non-contact development as in the first embodiment, substantially constant image quality was achieved without regard to temperature or humidity.

In the examples of the first and second embodiments, the conductive portions 42 of the roller 4 are higher than the dielectric portions 41, and non-contact development is effected. In such a case, in the developing region A, intense electric fields are generated on the conductive portions 42 which are closest to the drum 1, enhancing the contrast of an image.

3rd Embodiment

Figure 6A:
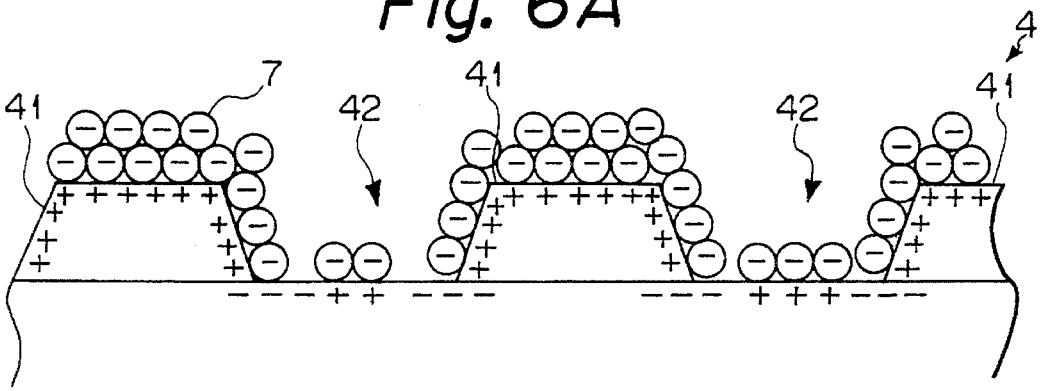
FIGS. 6A and 6B are sections respectively showing a roller surfaces in which the dielectric portions, implemented as projections, are positively charged and a roller surface in which they are negatively charged.
Figure 7A:
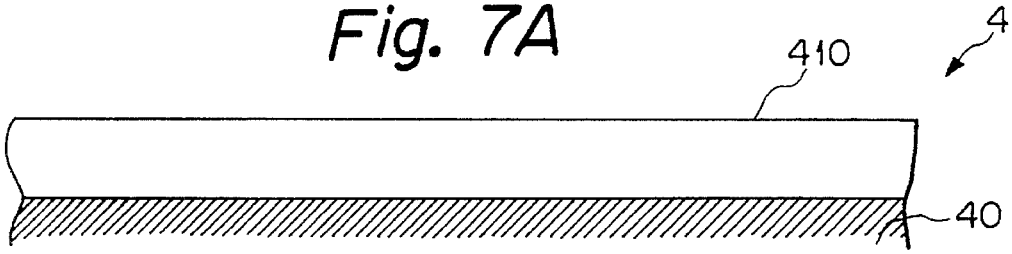
FIGS. 7A and 7B are sections representative of a procedure for producing a developing roller whose dielectric portions are implemented as recesses.
Figure 7B:
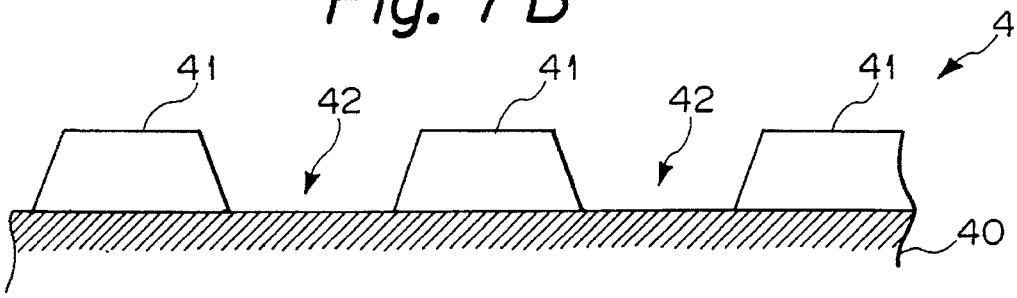

This embodiment is essentially similar to the first embodiment except that the surfaces of the dielectric portions 41 of the developing roller 4 are higher than those of the conductive portions 42, as shown in FIG. 6A. FIGS. 7A and 7B demonstrate a procedure for configuring the surface of the roller 4 particular to this embodiment. As shown, the surface of an aluminum core 40 is coated with a 20 μm to 30 μm thick layer of epoxy regenerated silicone resin 410 which is positively chargeable (see FIG. 7A). Then, the roller is knurled to remove the resin 410 in a crosshatch pattern with the result that the aluminum appears on the surface of the roller (see FIG. 7B). Alternatively, the resin 410 may be removed by etching, if desired.

4th Embodiment

Figure 6B:
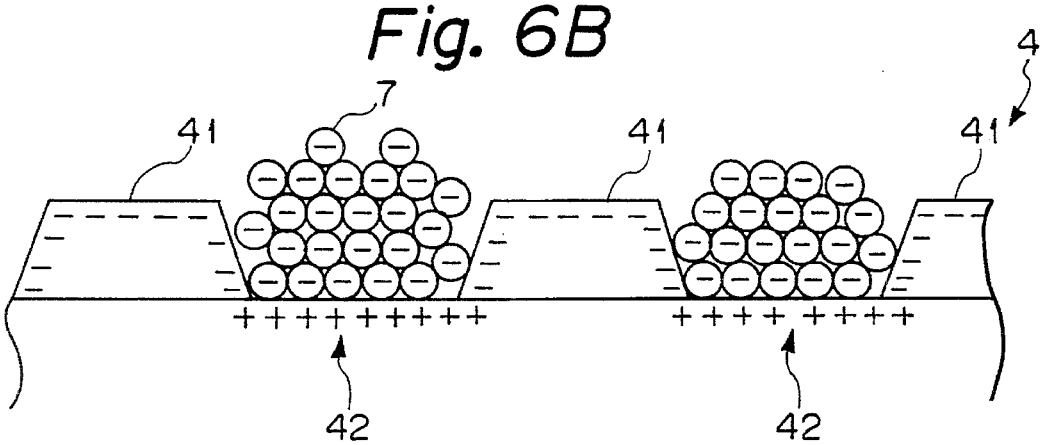

This embodiment is also essentially similar to the first embodiment except that the surfaces of the dielectric portions 41 of the developing roller 4 are higher than those of the conductive portions 42, as shown in FIG. 6B. FIGS. 7A and 7B also demonstrate a procedure for configuring the surface of the roller 4 of this embodiment. As shown, the surface of an aluminum core 40 is coated with a 20 μm to 30 μm thick layer of fluoric resin 410 which is negatively chargeable (see FIG. 7A). Then, the roller is knurled or etched to remove the resin 410 in a crosshatch pattern with the result that the aluminum appears on the surface of the roller (see FIG. 7B). In this configuration, the toner 7 electrostatically repulses the dielectric portions (resin) 41 while being attracted by the conductive portions (aluminum) 42 based on a mirror image force. As a result, multiple toner layers are formed on the conductive portions, or recesses, 42, as shown in FIG. 6B.

Figure 8:
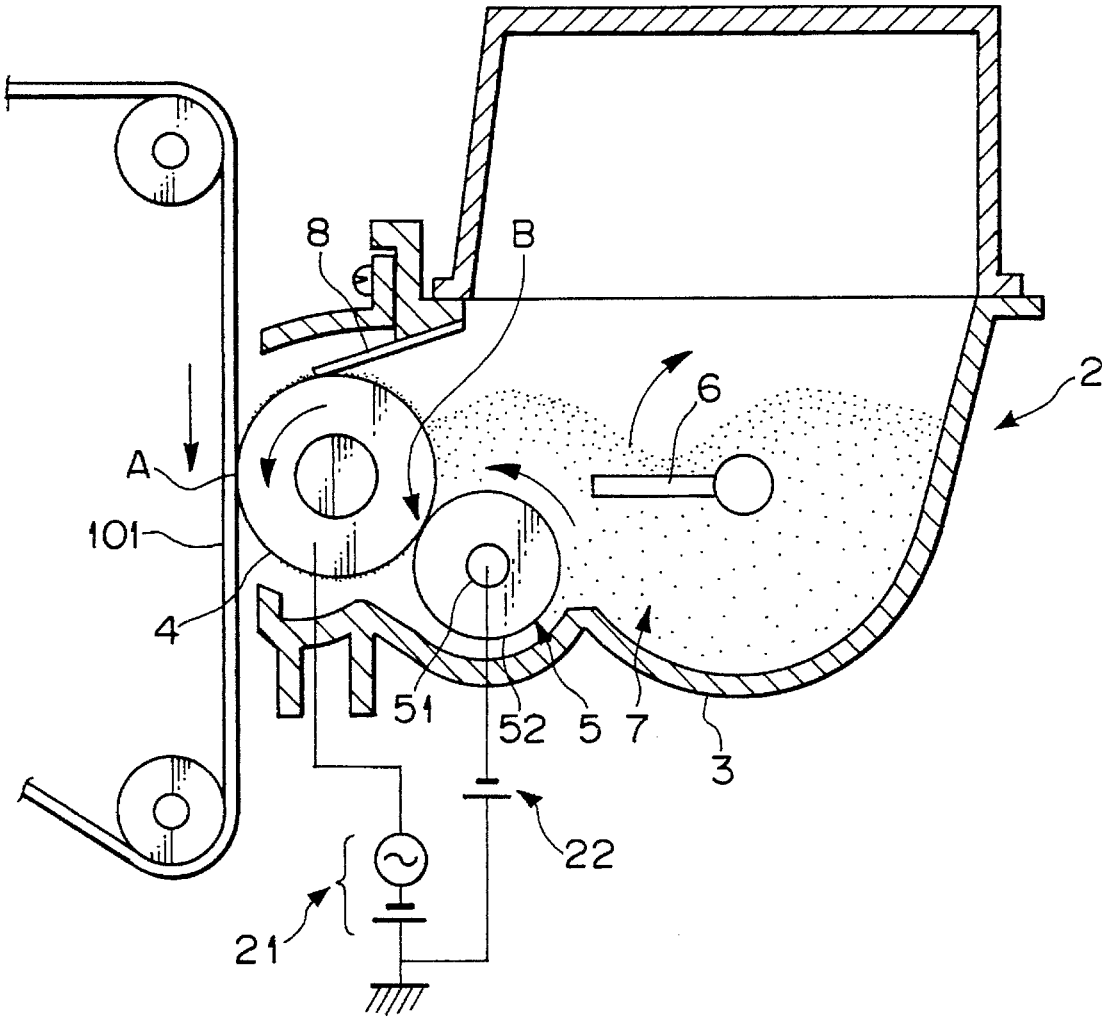
FIG. 8 is a section showing an alternative embodiment of the present invention.

The roller 4 of this embodiment was also found successful in forming on the roller 41 a toner layer having M/A ranging from 0.7 ranging mg/cm$^2$ to 1.2 mg/cm$^2$ and Q/M ranging from −6 μC/g to −15 μC/g at a temperature of 30° C. to 20° C. and humidity of 90% to 15%. When the developing device 2 was incorporated in the image forming apparatus of the type effecting contact development with the photoconductive belt 101, FIG. 8, substantially constant image quality was achieved without regard to temperature or humidity.

In the examples of the third and fourth embodiments, the dielectric portions 41 of the roller 4 are higher than the conductive portions 42, and contact development is effected. In this configuration, electric fields for development are generated in the developing region via the dielectric portions 41 which are closest to the belt 101. As a result, the amount of toner deposition on the low potential portions of a latent image formed on the belt 101 is smaller than conventional and coincides with a predetermined amount, thereby insuring desirable tonality.

5th Embodiment

Figure 9A:
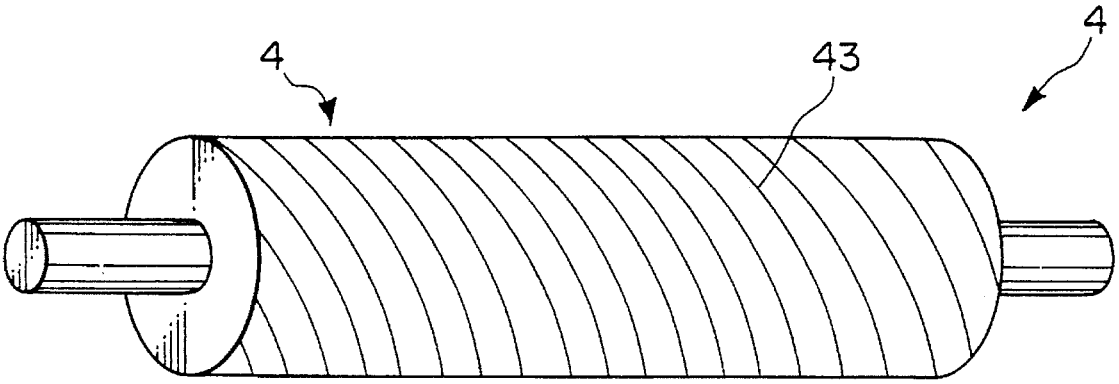
FIG. 9A is a perspective view of a developing roller formed with spiral grooves.
Figure 9B:
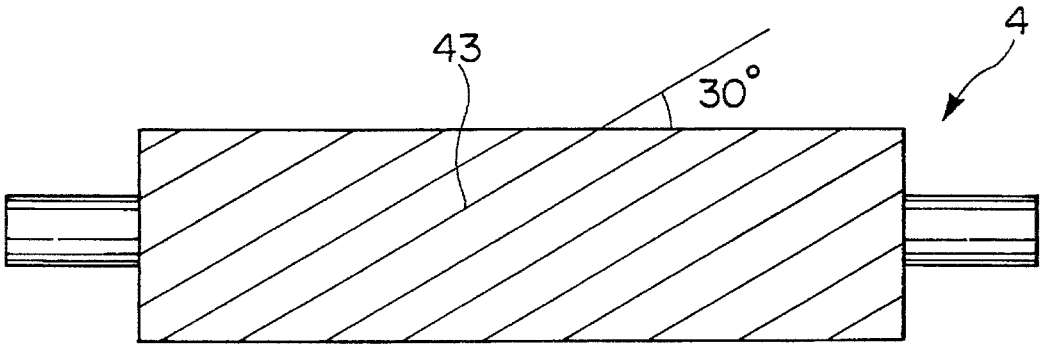
FIG. 9B is a side elevation associated with FIG. 9A.

This embodiment is essentially similar to the first embodiment except that, as shown in FIGS. 9A and 9B, the recesses on the surface of the developing roller 4 are implemented as spiral grooves 43. Assume that the spiral grooves 43 are nearly parallel to the axis of the roller 4. Then, horizontal lines in an image which are distributed in the direction of movement of the surface of the drum 1 (lines extending in the axial direction of the roller 4) will change in width in associated with the pitch of the spiral. In light of this, the embodiment inclines the spiral grooves 43 more than 30 degrees relative to the axis of the roller 4, as shown in FIG. 9B. With such spiral grooves 43, it was possible to reproduce horizontal lines in substantially constant density and, eventually, in constant width.

It is likely that this embodiment causes image density to change in the oblique direction corresponding to the inclination of the spiral grooves 43. However, such changes in image density in the oblique direction are not conspicuous in character images and line images. If desired, the spiral grooves 43 may be replaced with, for example, a great number of oblong circular grooves substantially parallel to each other.

6th Embodiment

This embodiment, like the first embodiment, uses the developing device 2. The toner 7 to form multiple layers on the developing roller 4 has a volumetric mean particle size of 10 μm. The roller 4 is provided with the same configuration as in the third embodiment. When the roller 4 was formed with 20 μm to 30 μm wide grooves on the surface thereof by etching, the toner 7 stopped the grooves after several hundreds of images were formed. As a result, M/A and, therefore, image density was lowered. To eliminate this problem, the embodiment provides the grooves with a width greater than 30 μm, preferably greater than 50 μm. This successfully eliminated the above occurrence insures and desirable image quality over a long period of time.

7th Embodiment

This embodiment, like the first embodiment, uses the developing device 2. The toner 7 to form multiple layers on the developing roller 4 has a volumetric mean particle size of 10 μm. The roller 4 is provided with the same configuration as in the third embodiment. For experiment, the metallic core 40 was coated with a 60 μm thick resin 410 and then knurled to expose the aluminum portion; the grooves of the roller 4 were measured to be 50 μm deep. The toner layers formed on this kind of roller 4 had Q/M as low as −3 μC/g and were brought to the developing region without any charge, contaminating the background of an image. In light of this, the embodiment controls the thickness of the resin 410 to less than 50 μm, preferably less than 30 μm. In this condition, the toner layers have Q/M of −10 μC/g which is great enough to free the background of an image from is contamination. In addition, the toner 7 sparingly scattered around.

8th Embodiment

This embodiment uses the same developing device 2, toner 7, image forming apparatus and developing method as the first embodiment. However, when the developing roller 4 was moved at substantially the same linear velocity as the drum 1, i.e., 200 mm/sec, marks corresponding to the grooves of the roller 4 appeared in the solid portions of an image, degrading image quality. In light of this, the embodiment moves the roller 4 at a slightly higher linear velocity than the drum 1, i.e., a linear velocity 1.1 times to 1.2 times the linear velocity of the drum 1. In this condition, a greater amount of toner deposits on the roller 4 to eliminate the irregular toner deposition attributable to the grooves of the roller 4. As a result, the solid portions of an image are provided with uniform density.

The first to eighth embodiments are shown and in described relation to negative-to-positive (N/P) development using a negatively chargeable photoconductive element. However, the present invention is practicable even with positive-to-positive (P/P) using a development positively chargeable toner, N/P development using a positively chargeable photoconductive element and positively chargeable toner, P/P development using a positively chargeable photoconductive element and negatively chargeable toner, etc. Further, the first to eight embodiments each forms groove-like recesses in the roller 4 by knurling or similar technology. If desired, the grooves may be replaced with, for example, a great number of circular recesses distributed over the surface of the roller 4.

In summary, it will be seen that the present invention has various unprecedented advantages, as enumerated below.

(1) One of a group of dielectric portions and a group of conductive portions formed on a developer carrier are implemented as recesses, while the other is implemented as projections. This enhances the vertically extending components of microfields formed between the two groups of portions and, therefore, allows a developer to be held by the developer carrier in multiple layers. In addition, the developer received in the recesses can be conveyed mechanically. As a result, the developer is held by the developer carrier more strongly than conventional and can be conveyed to an image carrier in stable multiple layers. It follows that even when ambient temperature and/or humidity changes, e.g., when humidity rises, stable developer layers can be formed on the developer carrier and conveyed to the image carrier despite that the charge deposited on the dielectric portions falls. Therefore, an attractive image is insured. When the difference in height between the two groups of portions is greater than one-half of the volumetric mean particle size of the developer, the developer can be held in the regions where the vertically extending components of the microfields on the developer carrier are formed. This, coupled with the fact that the recesses are deep enough to convey the developer mechanically, insures stabler multiple developer layers even when the ambient temperature and/or humidity changes, e.g., when humidity rises, despite that the charge deposited on the dielectric portions falls.

(2) A charge opposite in polarity to the charge of the developer is deposited on the dielectric portions so as to form electric fields which attract the developer. Hence, multiple developer layers can be formed more stably.

(3) When a charge of the same polarity as the charge of the developer is deposited on the dielectric portions, the developer electrostatically repulses the dielectric portions while being attracted by the conductive portions by a mirror image force. This is successful in further promoting the formation of stable multiple developer layers.

(4) The dielectric portions are higher than the conductive portions, and contact development is effected. In this configuration, electric fields for development are generated in a developing region via the dielectric portions which are closest to the image carrier. As a result, the amount of toner deposition on the low potential portions of a latent image formed on the image carrier i s smaller than conventional and coincides with a predetermined amount, thereby insuring desirable tonality.

(5) When the conductive portions are higher than the dielectric portions, intense electric fields for development are generated in the developing region on the conductive portions which are closest to the image carrier. Hence, in a non-contact development system wherein the image carrier and developer carrier do not contact, images with a clear contrast are achievable.

(6) The image carrier is comprised of a cylindrical rotary body while the recesses are implemented as grooves intersecting the axis of rotation of the developer carrier. In this condition, even when the developer carrier and image carrier are driven at linear speeds close to each other, the amount of developer to deposit on the image carrier, as measured in the axial direction (horizontal direction), is prevented from changing substantially at the same time in the direction perpendicular thereto, i.e., in the direction of movement of the image carrier. As a result, image density is prevented from changing among the horizontal lines of an image which are distributed in the direction in which the surface of the image carrier moves.

(7) When the width of each recess is more than three times as great as the volumetric mean particle size of the developer, the developer received in the recesses is allowed to flow on contacting a developer supply member or the like. It follows that the developer is surely prevented from stopping the recesses.

(8) When the depth of the recesses is less than five times the volumetric mean particle size of the developer, an occurrence that a great amount of uncharged developer enters the recesses and reaches the image carrier is eliminated. This obviates the scattering of the developer and the contamination of background.

(9) When the developer carrier is moved at a higher linear velocity than the image carrier, a sufficient amount of developer can be deposited on a solid image. Hence, when the recesses of the developer carrier are implemented as a regular groove pattern, marks of the grooves are prevented from appearing in an image. Hence, a solid image having a uniform density distribution is achievable.

Various modifications will become possible for those skilled in the art after receiving the teachings of the present disclosure without departing from the scope thereof.

What is claimed is:

1. A developing device comprising:

a developer carrier for carrying a developer thereon to develop a latent image formed on an image carrier, the developer carrier including a surface having a plurality of raised portions and a plurality of recessed portions distributed thereon, said raised portions and said recessed portions having a difference in height which is greater than one-half of a mean particle size of said developer, and wherein one of said plurality of recessed portions and said plurality of raised portions includes dielectric surfaces and the other of said plurality of recessed portions and said plurality of raised portions includes conductive surfaces;

a developer supply roller for supplying developer to said developer carrier, said developer supply roller having a conductive elastic outer surface in contact with said developer carrier;

wherein fine closed electric fields are formed on said developer carrier causing developer to deposit on said surface of said developer carrier in multiple layers; and wherein 40%–70% of said surface of said developer carrier constitutes said dielectric surfaces and a remainder of said surface of said developer carrier constitutes said conductive surfaces.

2. A device as claimed in claim 1, wherein a charge opposite in polarity to a charge to be deposited on the developer is deposited on said dielectric surfaces.

3. A device as claimed in claim 1, wherein a charge of a same polarity as a charge to be deposited on the developer is deposited on said dielectric surfaces.

4. A device as claimed in claim 1, wherein said dielectric surfaces are provided on said raised portions.

5. A device as claimed in claim 1, wherein said recessed portions each has a width more than three times as great as a mean particle size of the developer.

6. A device as claimed in claim 1, wherein said recessed portions each has a depth less than five times a particle size of the developer.

7. A device as claimed in claim 1, wherein said developer carrier is moved at a higher linear velocity than said image carrier.

8. The developing device of claim 1, further including a power supply connected to each of said developer carrier and said developer supply roller.

9. The developing device of claim 8, wherein said power supply applies bias voltages to said developer carrier and said developer supply roller to provide a potential difference of 50 V to 350 V between said developer carrier and said developer supply roller.

10. The developing device of claim 1, wherein said developer supply roller includes a conductive core about which said conductive elastic outer surface is disposed.

11. A developing device comprising:

a developer carrier for carrying a developer thereon to develop a latent image formed on an image carrier, the developer carrier including a surface having a plurality of raised portions and a plurality of recessed portions distributed thereon, said raised portions and said recessed portions having a difference in height which is greater than one-half of a mean particle size of said developer, and wherein one of said plurality of recessed portions and said plurality of raised portions includes dielectric surfaces and the other of said plurality of recessed portions and said plurality of raised portions includes conductive surfaces;

a developer supply roller for supplying developer to said developer carrier, said developer supply roller having a conductive elastic outer surface in contact with said developer carrier;

wherein fine closed electric fields are formed on said developer carrier causing developer to deposit on said surface of said developer carrier in multiple layers;

wherein said conductive surfaces are provided on said raised portions.

12. A developing device comprising:

a developer carrier for carrying a developer thereon to develop a latent image formed on an image carrier, the developer carrier including a surface having a plurality of raised portions and a plurality of recessed portions distributed thereon, said raised portions and said recessed portions having a difference in height which is greater than one-half of a mean particle size of said developer, and wherein one of said plurality of recessed portions and said plurality of raised portions includes dielectric surfaces and the other of said plurality of recessed portions and said plurality of raised portions includes conductive surfaces;

a developer supply roller for supplying developer to said developer carrier, said developer supply roller having a conductive elastic outer surface in contact with said developer carrier;

wherein fine closed electric fields are formed on said developer carrier causing developer to deposit on said surface of said developer carrier in multiple layers;

wherein said image carrier comprises a cylindrical rotary body while said recessed portions comprise helical grooves extending about said cylindrical rotary body.

13. A developing device having a developer carrier whose surface is comprised of a mixture of dielectric portions and conductive portions distributed regularly or irregularly, said developing device forming fine closed electric fields on said developer carrier by selectively charging said surface of said developer carrier, causing a developer to deposit on said surface in multiple layers due to said electric fields, and developing a latent image electrostatically formed on an image carrier by said developer, wherein one of said dielectric portions and said conductive portions constitutes recessed portions having a difference in height which is greater than one-half of a volumetric mean particle size of said developer, while the other of said dielectric portions and said conductive portions constitutes raised portions, and wherein a charge opposite in polarity to a charge to be deposited on the developer is deposited on said dielectric portions; and wherein 40%–70% of said surface of said developer carrier constitutes said dielectric portions and a remainder of said surface of said developer carrier constitutes said conductive portions.

14. A developing device having a developer carrier whose surface is comprised of a mixture of dielectric portions and conductive portions distributed regularly or irregularly, said developing device forming fine closed electric fields on said developer carrier by selectively charging said surface of said developer carrier, causing a developer to deposit on said surface in multiple layers due to said electric fields, and developing a latent image electrostatically formed on an image carrier by said developer, wherein one of said dielectric portions and said conductive portions constitutes recessed portions having a difference in height which is greater than one-half of a volumetric mean particle size of said developer, while the other of said dielectric portions and said conductive portions constitutes raised portions, and wherein a charge of a same polarity as a charge to be deposited on the developer is deposited on said dielectric portions; and wherein 40%–70% of said surface of said developer carrier constitutes said dielectric portions and a remainder of said surface of said developer carrier constitutes said conductive portions.

* * * * *